US006631911B2

(12) United States Patent
Chen et al.

(10) Patent No.: US 6,631,911 B2
(45) Date of Patent: Oct. 14, 2003

(54) COMBINED STRUCTURE OF A SPORTS SHOE AND AN IN-LINE SKATE

(76) Inventors: Ching-Long Chen, 2F, No. 2, Lane 173, Dahushanjuang St., Neihu Chiu, Taipei City (TW); Ching-Lin Chen, 9F, No. 388, Sec. 2, Futzuen Rd., Yuanlin Jen, Changhua Hsien (TW)

( * ) Notice: Subject to any disclaimer, the term of this patent is extended or adjusted under 35 U.S.C. 154(b) by 0 days.

(21) Appl. No.: 09/866,679

(22) Filed: May 30, 2001

(65) Prior Publication Data

US 2003/0001347 A1 Jan. 2, 2003

(51) Int. Cl.[7] ..... A63C 17/04

(52) U.S. Cl. ..... 280/11.223; 280/11.27; 280/11.221; 280/11.232

(58) Field of Search ..... 280/11.221, 11.25, 280/11.27, 11.223, 11.232, 11.233, 841, 11.19, 7.13, 11.26, 43.24; 36/114, 115, 116, 25 R, 132

(56) References Cited

U.S. PATENT DOCUMENTS 3,983,643 A * 10/1976 Schreyer et al. ..... 280/11.19
6,120,039 A * 9/2000 Clementi ..... 280/11.19
6,247,708 B1 * 6/2001 Hsu ..... 280/11.223
6,308,964 B1 * 10/2001 Chang ..... 280/11.19
6,328,318 B1 * 12/2001 Hsu ..... 280/11.223
6,336,644 B1 * 1/2002 Chu ..... 280/11.221
6,343,800 B2 * 2/2002 Clementi ..... 280/11.223
6,364,322 B1 * 4/2002 Lee ..... 280/11.27
6,386,555 B1 * 5/2002 Kao ..... 280/11.19
6,386,556 B1 * 5/2002 Yeh ..... 280/11.223
6,394,468 B1 * 5/2002 Chiang et al. ..... 280/11.223
6,402,162 B1 * 6/2002 Chiang ..... 280/11.19
6,406,037 B2 * 6/2002 Chang ..... 280/11.19
2001/0022433 A1 * 9/2001 Chang ..... 280/11.19
2002/0060435 A1 * 5/2002 Kim ..... 280/11.223
2002/0070513 A1 * 6/2002 Chang ..... 280/11.221
2002/0089132 A1 * 7/2002 Chu ..... 280/11.223

* cited by examiner

*Primary Examiner*—Brian L. Johnson
*Assistant Examiner*—J. Allen Shriver
(74) *Attorney, Agent, or Firm*—Rosenberg, Klein & Lee

(57) ABSTRACT

A combined structure of a sports shoe and an in-line skate mainly comprises an in-line wheel device buried in the shoe bottom of a sports shoe. The in-line wheel device comprises a base, whereon a linkage set, a position plate, a wheel position mechanism and a torsion spring are combined in order at both sides by position pins and shaft bars and arrangement at each side is homologous with the other side such that wheels are set among two sides and arranged in in-line state. Besides, a control mechanism is combined to the rear of the base and can control wheels to be unfolded and taken in automatically such that the shoe body combined with an in-line wheel device can take wheels in the sole ordinarily for walking and running, and unfold wheels automatically when the user wants to take skating sport.

3 Claims, 10 Drawing Sheets

COMBINED STRUCTURE OF A SPORTS SHOE AND AN IN-LINE SKATE

BACKGROUND OF THE INVENTION

1. Field of the Invention

The present invention relates to a combined structure of a sports shoe and an in-line skate, especially the one that the in-line wheels can be placed into the sole such that the shoe has the function of sport and wheels.

2. Description of the Prior Art

In-line skating sport is a very popular sport in these days, and, we can see that people of all ages and both sexes are skating with putting on in-line skates in any spacious place. Skating sport promotes not only sports and sweating effect but also emotion of relatives and friends, and may be called a proper exercise for both the old and the young.

However, playing in-line skating sport has to put on an in-line skate to proceed skating motion such that users are not able to proceed skating activity anywhere and anytime. The user has to bring an in-line skate on his/her person, and enormous volume of an in-line skate makes inconvenience of the user for bringing. Therefore, if in-line wheels can be combined with the body of the shoe, the user can walk and run with wearing the shoe ordinarily and take out wheels while skating. In this way, the user can proceed skating anywhere and anytime, and the in-line skate does not have to be brought on the user's person.

Otherwise, the habitually used shoe for both sport and skate, such as Taiwan, R.O.C. Patent 89211791 (the case is called "quoted case" in following text), is a skate with four wheels but not an in-line skate. Therefore, for conforming to the tide and trend, the present invention was aimed at the structure of the quoted case for improvement, and then the product of a shoe having both functions of sport and skate was invented. So the present invention can be called the second-generation product of the quoted case.

SUMMARY OF THE INVENTION

The purpose of the present invention is to provide a combined structure of a sports shoe and an in-line skate, wherein in-line wheels can be placed into the sole of the sports shoe such that the sports shoe provides both function of walking and skating.

The second purpose of the present invention is to provide a combined structure of a sports shoe and an in-line skate, which applies synchronic motion principle such that controlling one wheel can drives other wheels to act and rapid control can be achieved.

Another purpose of the present invention is to provide a combined structure of a sports shoe and an in-line skate, which makes wheels be taken in and out automatically by control of the control mechanism.

The combined structure of a sports shoe and an in-line skate that can achieve purposes described above comprises a body, an in-line wheel device, and a control mechanism. Said control mechanism is set at the rear of the in-line wheel device, which is buried in the sole of the body of the shoe. Said in-line wheel device has a base, which is relatively joined with a linkage set, a position plate and a wheel position mechanism in turns at both sides with using some shaft links and some position pins to pass through such that the linkage set, the position plate and the wheel position mechanism at each side of the base can be joined steadily and the arrangement at every side is in homologous state.

Besides, wheels are set between homologous wheel position mechanisms and arranged in in-line state. In addition, for the sake of that the wheel position mechanism is joined to the linkage set, controlling only one turning plate of the wheel position mechanism can make other turning plates act synchronically. A placing room is set at the bottom of the base to place the wheels joined between the wheel position mechanisms of both sides such that wheels can be placed in the sole of the shoe and thus the user can walk or run. When the user wants to skate, the user can press the push bar of the control mechanism to make the wheels unfold automatically for skating such that the user can skate anywhere and anytime, and doesn't have to bring the in-line skate with his/her person.

BRIEF DESCRIPTION OF THE DRAWINGS

The drawings disclose an illustrative embodiment of the present invention which serves to exemplify the various advantages and objects hereof, and are as follows.

[Diagram Remarks]

| | |
|---|---|
| 1 | Base |
| 11 | Bottom surface |
| 12 | Placing room |
| 121 | Guide channel |
| 122 | Lengthwise slot |
| 13 | Guide opening |
| 14 | Trench |
| 15 | Position column |
| 16 | Position column |
| 2 | Linkage set |
| 21 | First link |
| 211–216 | Joining hole |
| 22 | Second link |
| 23 | Third link |
| 3 | Position plate |
| 31–34 | Arc slot |
| 311 | Plate-hole |
| 35 | Position hole |
| 36 | Position hole |
| 37 | Guide slot |
| 4 | Wheel position mechanism |
| 41 | Turning plate |
| 411–418 | Hole |
| 421–424 | Hole |
| 441 | Breach |
| 442 | Breach |
| 5 | Control mechanism |
| 51 | Control part |

-continued

| | |
|---|---|
| 511 | Push bar |
| 512 | Compression spring |
| 513 | Washer |
| 514 | Washer-hole |
| 515 | Protruding block |
| 52 | Guide part |
| 521 | Torsion spring |
| 522 | Guide arm |
| 523 | Position bar |
| 524 | Guide bar |
| 525 | Lodging fillister |
| 526 | Trough |
| 527 | Ear |
| 5271 | Ear hole |
| 528 | Ear |
| 5281 | Ear hole |
| 6 | Upper cover |
| 7 | Torsion spring |
| 81–84 | Position pin |
| 91–94 | Turning shaft |
| 10 | Body |
| 101 | Sole |
| 20 | Wheel |
| 30 | Shaft bar |

DETAILED DESCRIPTION OF THE PREFERRED EMBODIMENT

Figure 1:
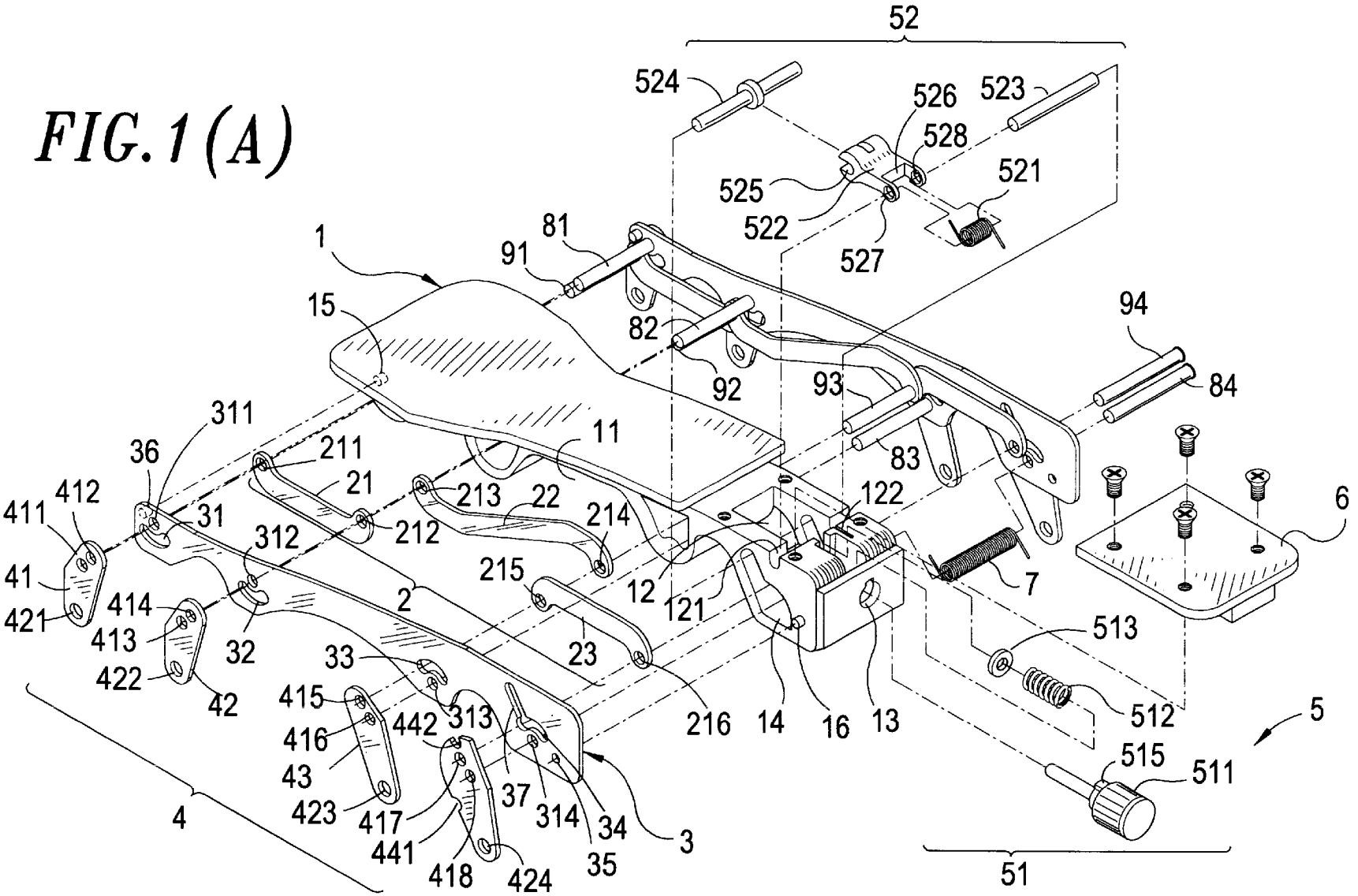
FIGS. 1(A), (B), (C), (D) are the combination schematic diagram of the in-line wheel device of the present invention, a combined structure of a sports shoe and an in-line skate.
Figure 1B:
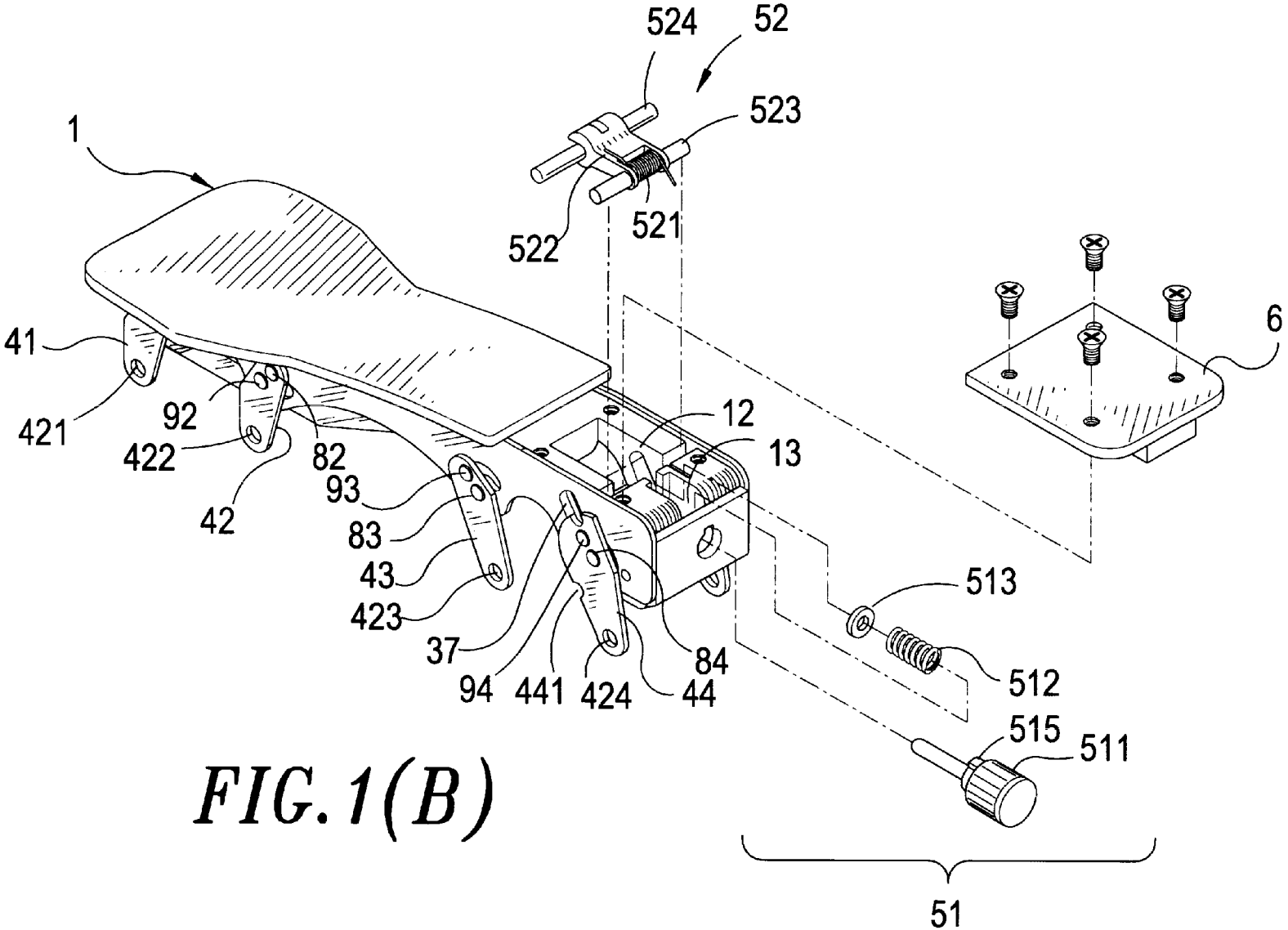
Figure 1:
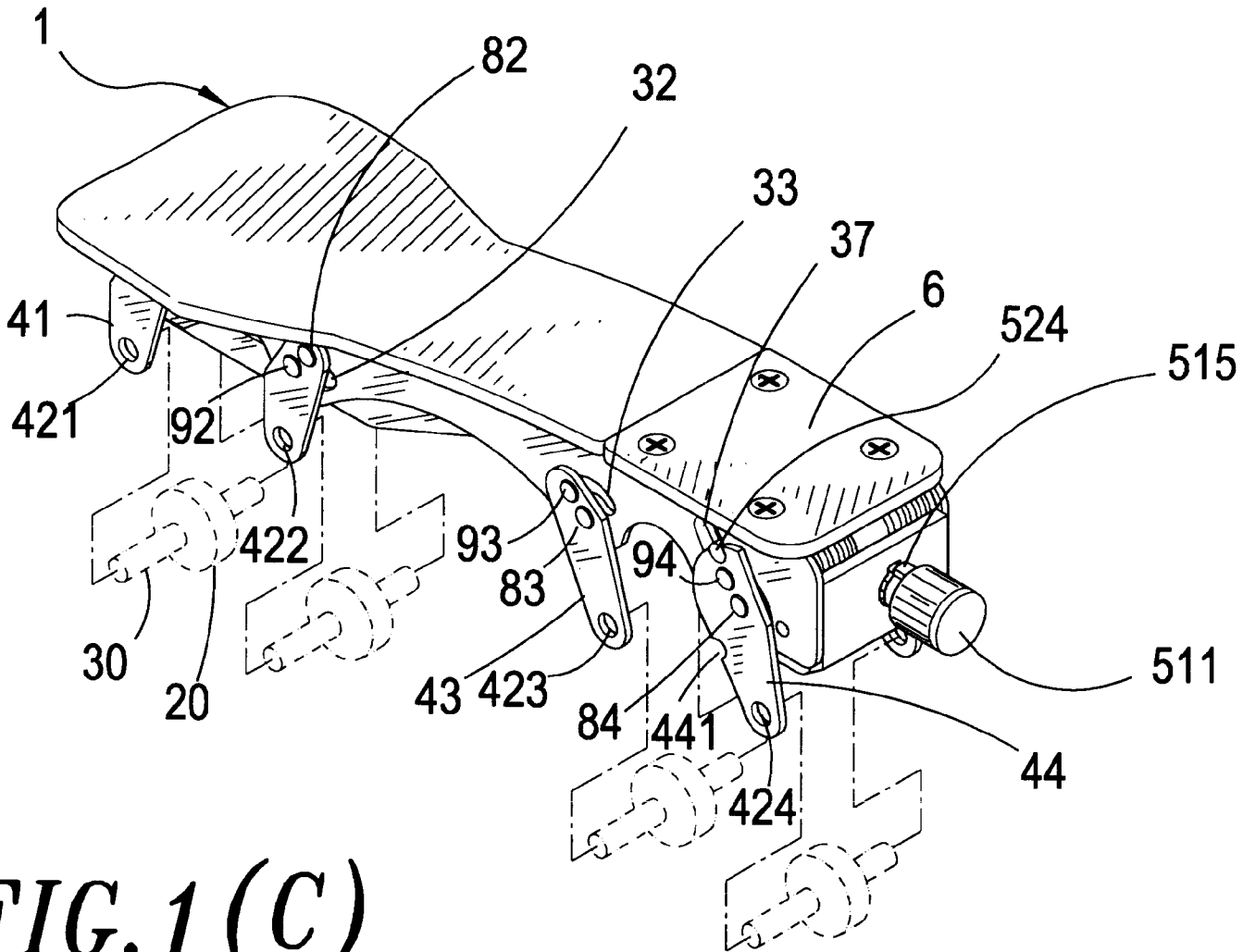
Figure 1D:
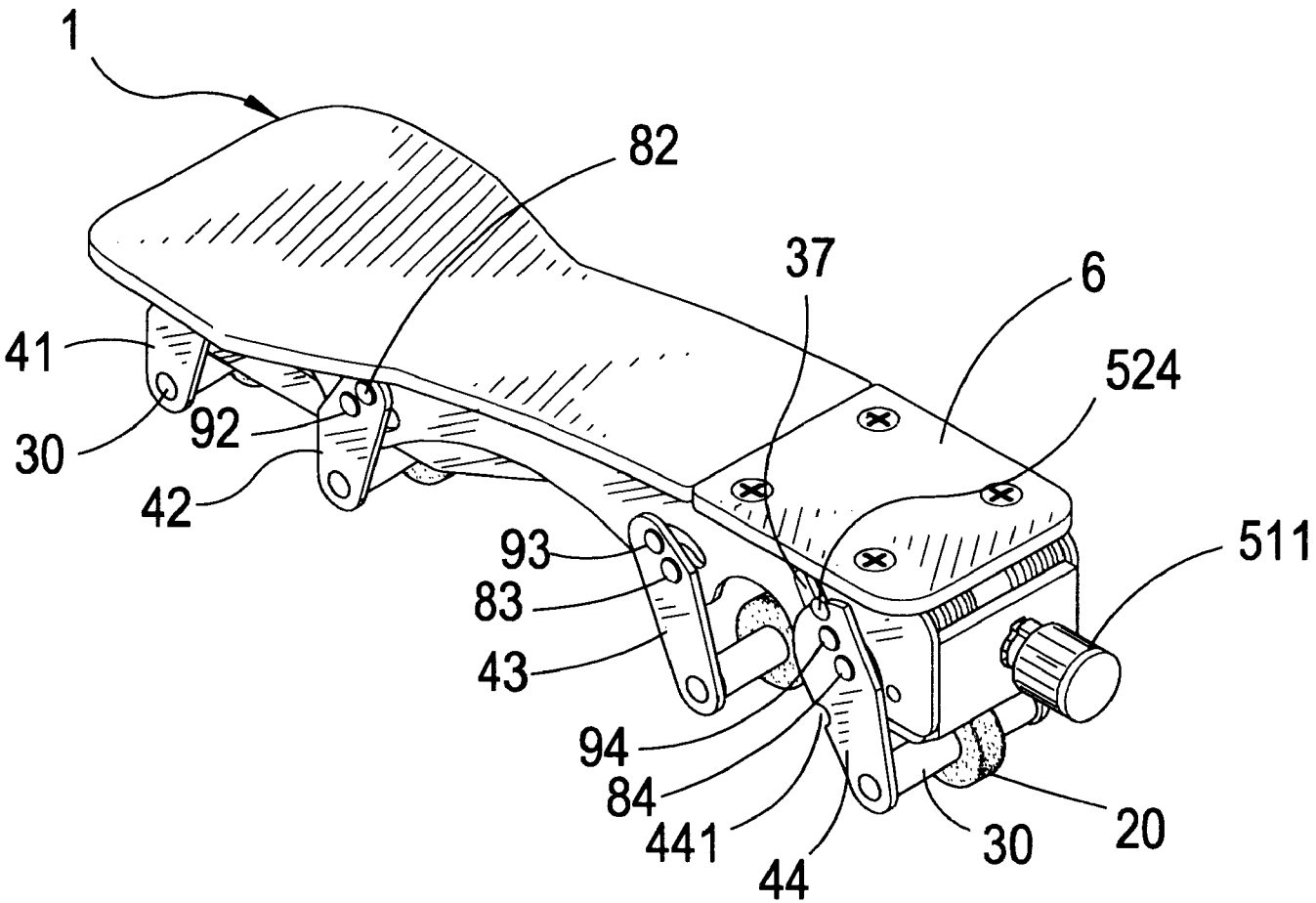

Please refer to FIGS. 1A, B, C, D, which are the combination schematic diagram of an in-line wheel device of the present invention, a combined structure of a sports shoe and an in-line skate, the in-line wheel device mainly comprises components as follows:

A base 1 is set in the present invention and has a bottom surface 11 in a wavy shape to serve as a placing space of wheels. A placing room 12 is set at the rear of the base 1. A transverse channel 121 and a lengthwise slot 122 are set at the top surface and a guide opening 13 is set at the end of the placing room 12. The placing room 12 and the guide opening 13 described above provide the connection of a control mechanism 5. A trench 14 are set at the rear of the base 1, and passes through the placing room 12, and position columns 15, 16 are set at two sides of both the front and rear ends of said base 1;

A control mechanism 5 is composed of a control part 51 and a guide part 52. The control part 51 comprises a push bar 511 on which a protruding block 515 is set at one side. A compression spring 512 and a hollow washer 513 are slipped on the push bar 511, and a washer-hole 514 is set on the washer 513 to let the push bar 511 pass through. The control part 51 is set into the guide opening 13, and the press part of the push bar 511 juts out of the guide opening 13. The guide part comprises a guide arm 522, and a lodging fillister 525 set at the front end of the guide arm 522 to clip the guide bar 524. A trough 526 is set at the rear end of the guide arm 522 to make both sides of the trough 526 form a pair of corresponding ears 527, 528. A pair of corresponding ear holes 5271, 5281 are respectively set on the pair of ears 527, 528. A torsion spring 521 is placed between the pair of ears 527, 528, and then a position bar 523 passes through the pair of holes 5271, 5281 to make the torsion spring 521 slipped on the position bar 523 and combined into the pair of ears 527, 528 of the guide arm 522. The position bar 523 is then placed into the transverse channel 121 at the rear end of the base 1 to make one end of the torsion spring 521 to hold on the wall surface of the trough 526 of the guide arm 522, and the other end hold into the lengthwise slot 122 of the placing room 12. The guide bar 524 in the lodging fillister 525 at the front end of the guide arm 522 juts out the trench 14 of the rear end of the base 1. The control mechanism 5 is connected to the rear end of the base 1 by covering with an upper cover 6.

A linkage set 2 comprises a first link 21, a second link 22 and a third link 23. Both ends of the first link 21 and the third link 23 are bended for a certain angle, and have joining holes 211, 212 and 215, 216. The second link 22 is made in step shape, and joining holes 213, 214 are set at both ends to respectively be joined with the joining hole 212 of the first link 21 and the joining hole 215 of the third link 23 such that the first, second, third link 21, 22, 23 can be joined to form a set of linkage to have related motion.

A position plate 3 wherein position holes 35, 36 are respectively set at both ends is set. Besides, four arc slots 31, 32, 33, 34 with plate-holes 311, 312, 313, 314 setting above the concave side for each arc slot set on the position plate 3, and a guide slot 37 is extended from one end of the slot 34.

A wheel position mechanism 4 comprises a first, second, third, and fourth turning plate 41, 42, 43, 44, whereon holes 411~418 locating in proper order are set at the top end and holes 421~424 for joining wheels are set at the bottom end for each turning plate 41, 42, 43, 44. Breaches 441, 442 are set at proper positions respectively at the upper and lower sides of the fourth turning plate 44 for clipping.

When being assembled, the linkage set 2, the position plate 3, and the wheel position mechanism 4 are combined in order on both sides of the base 1. Then four position pins 81~84 are passed through every pair of holes 411–418 on the top end of first, second, third, fourth turning plate 41~44, and four arc slots 31~34 of the position plate 3, and plate-holes 311~314 above the concave side of the arc slots, and the joining holes 211~216 of the first, second, third links 21~23 such that the linkage set 2, the position plate 3 and the wheel position mechanism 4 can be joined steadily at both sides of the base 1, and the arrangement of both sides is in homologous state. The position holes 35, 36 of position plate 3 can be joined with a pair of position columns 15, 16 such that the position plate 3 can be secured to each side of the base 1. A torsion spring 7 is slipped on the fourth position pin 84, and an end of the torsion spring 7 is hold to the forth shaft bar 94 while the other end is hold to the placing room 12 of the base 1. The guide bar 524 jutting out the trench 14 at the rear of the base 1 passes through the guide slot 37 of the position plate 3, and can clip with the breach 442 with the fourth turning plate 44. In the way described above, the in-line wheel device is performed.

Figure 2:
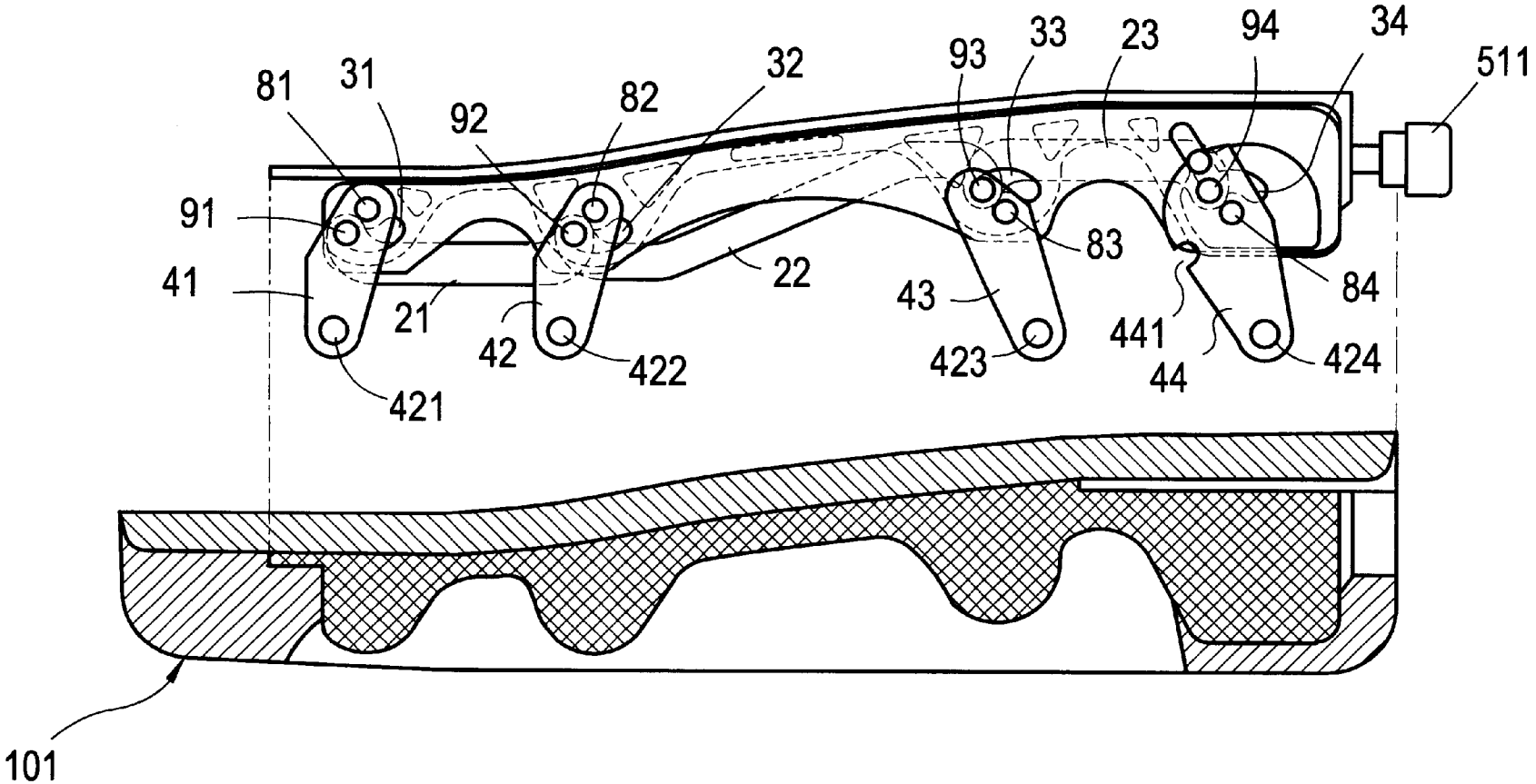
FIG. 2 is the schematic diagram of the combination of the in-line wheel device combining with the sole of the shoe of the present invention, a combined structure of a sports shoe and an in-line skate.
Figure 3A:
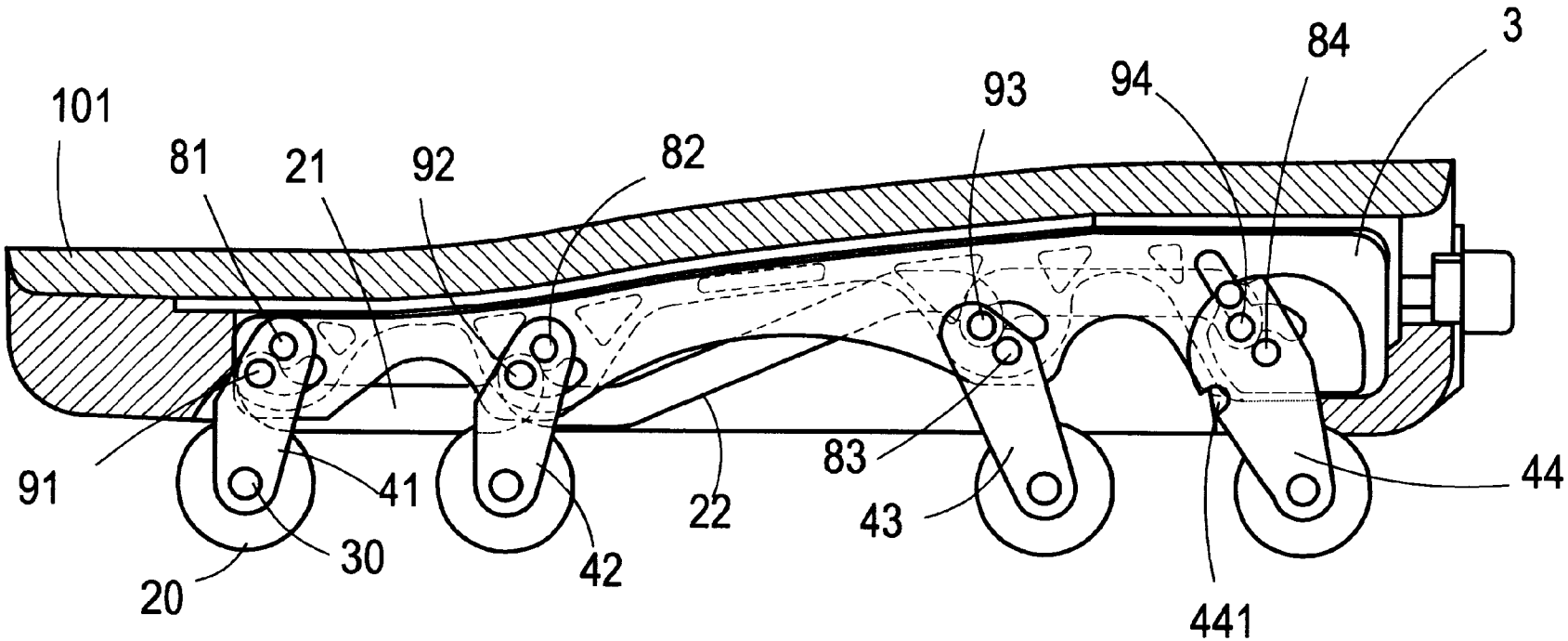
FIGS. 3(A), (B) are the schematic diagram of the present invention, a combined structure of a sports shoe and an in-line skate, with wheels.
Figure 3B:
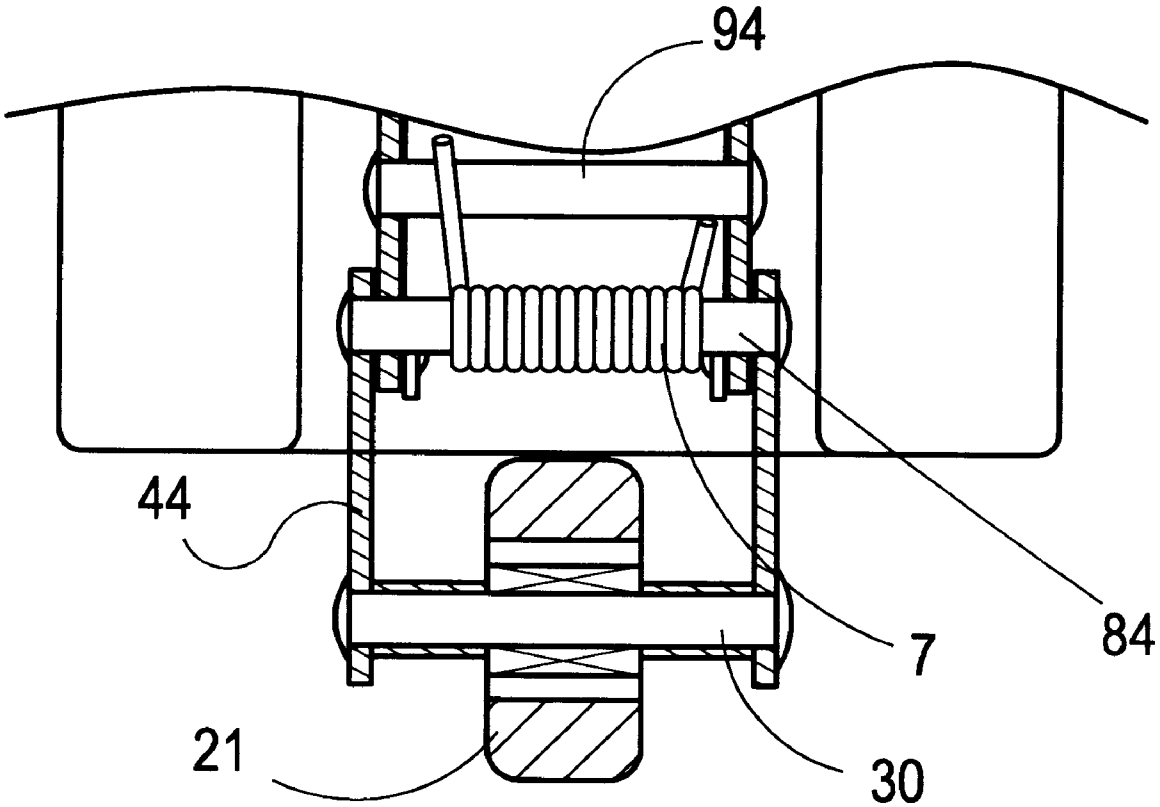

Please refer to FIG. 2 and FIGS. 3(A), (B), the in-line wheel device can be combined with the sole 101 of the shoe body 10 after assembling. A wheel 20 is set between every corresponding turning plates 41~44, and a shaft bar 30 are passed through the holes 421~424 of the turning plates 41~44 to make wheels 20 combined between the turning plates 41~44 at both sides and arranged in the in-line way (as shown in FIGS. 3(A), (B)).

Figure 4A:
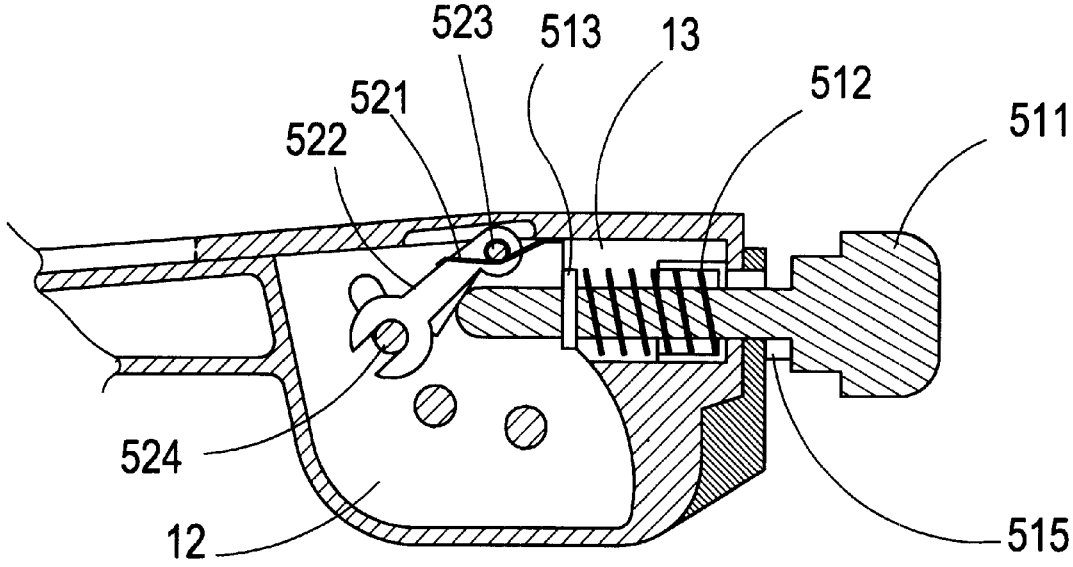
FIGS. 4(A), (B) are the schematic diagram of the control mechanism of the present invention, a combined structure of a sports shoe and an in-line skate.
Figure 4B:
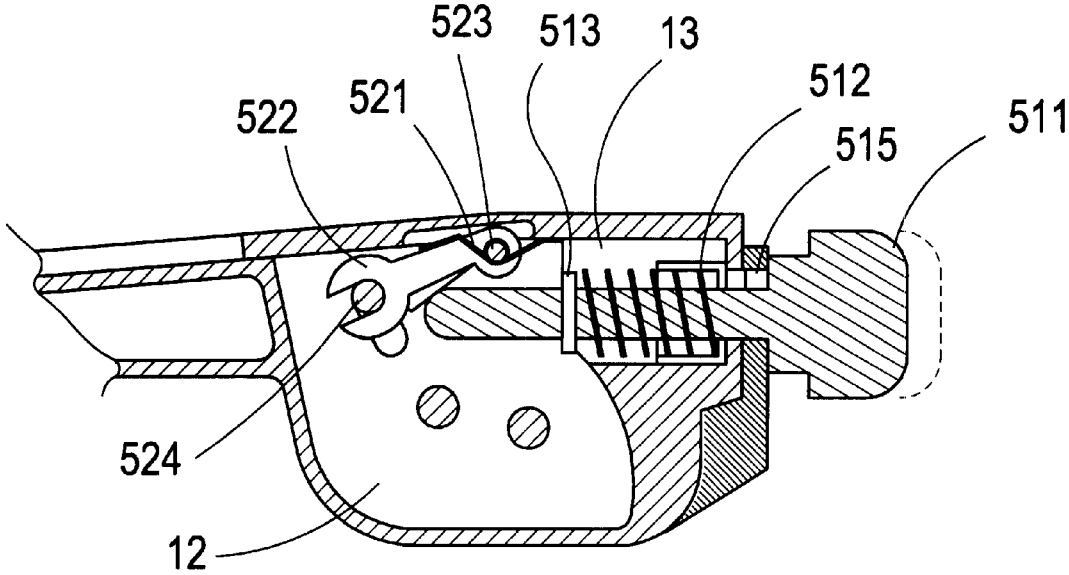
Figure 5:
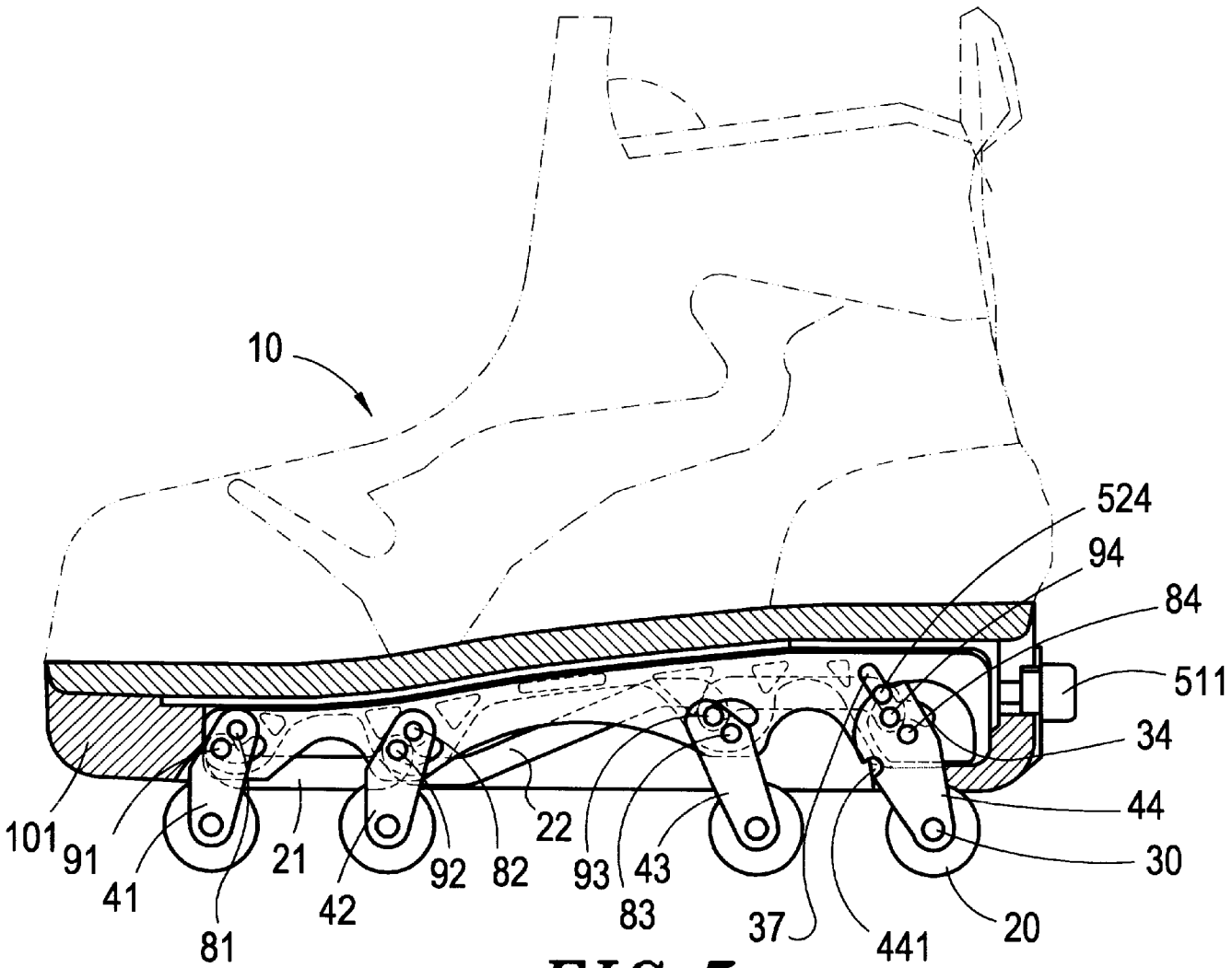
FIG. 5 is the schematic diagram of the unfolded wheels of the present invention, a combined structure of a sports shoe and an in-line skate.
Figure 6:
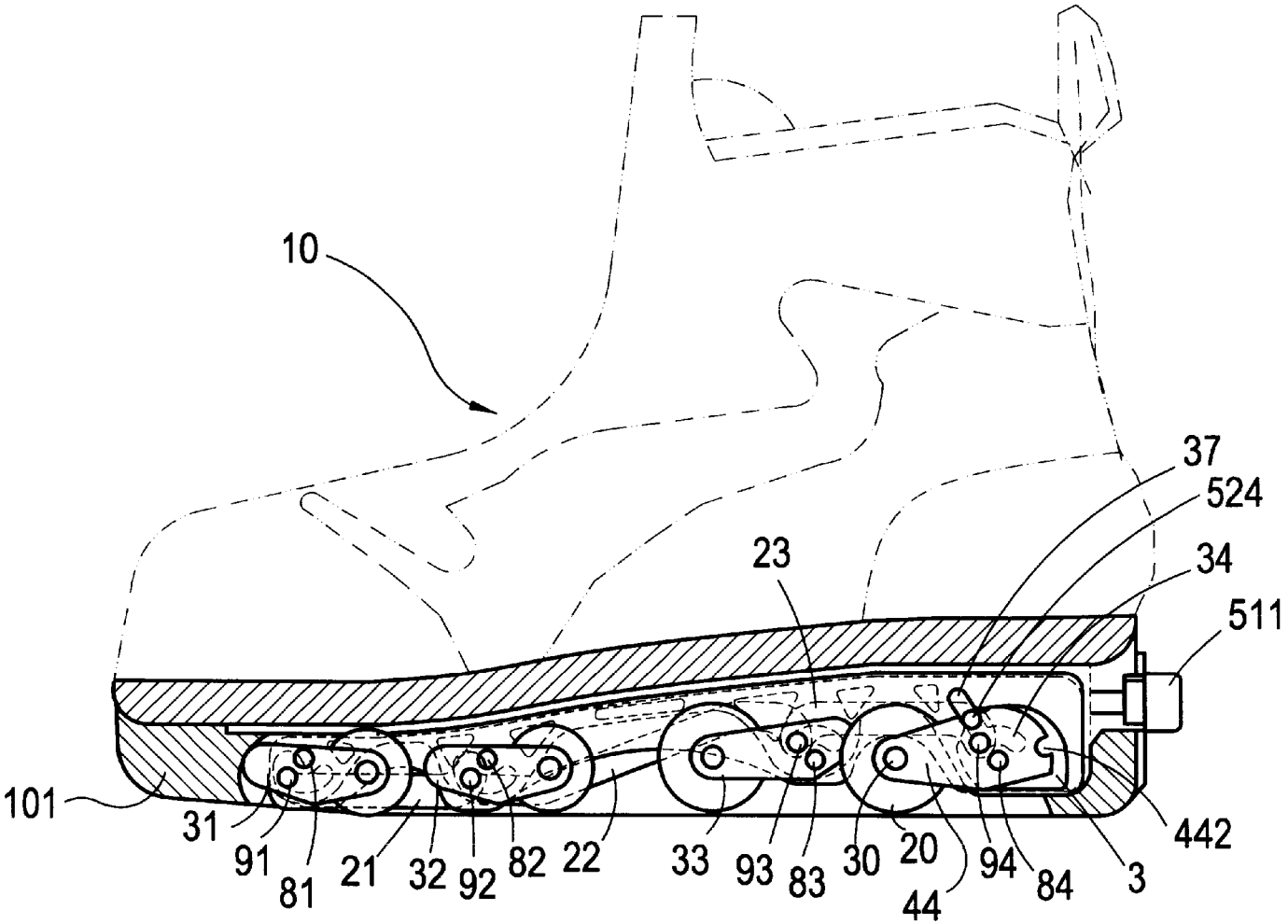
FIG. 6 is the schematic diagram of the folded wheels of the present invention, a combined structure of a sports shoe and an in-line skate.

Please further refer to FIGS. 4(A), (B), FIG. 5 and FIG. 6, which are schematic diagram of the control and action of the present invention, when the user wants to transform the shoe body 10 into an in-line skate, he/she can press the push bar 511 of the control mechanism 5 to make the front end of the push bar 511 contact the guide bar 522 and the guide bar 522 shifts upward for a certain angle such that the guide bar 524 clipping with the lodging fillister at the front end of the guide arm 522 has synchronic motion and slides upward in the guide slot 37 of the position plate 3. Then the guide bar 524 departs from the breach 441 of the fourth turning plate 44 such that the fourth shaft bar 94 moves along the fourth arc slot 34 of the position plate 3 due to the elastic force of the torsion spring 7 slipped on the fourth position pin 84. In this way, the linkage set 2 and the wheel position mechanism 4 are driven such that the wheel position mechanism 4 springs out of the sole 101 of the shoe. The push bar 511 and the guide arm 522 go back to the original positions due to the affection of the elastic force of the compression spring 512 and the torsion spring 521 to make the guide bar 524 go back such that the breach 442 of the fourth turning plate 44 can clip on the guide bar 524 to let the fourth turning plate 44 be positioned and other turning plates 41~43 be positioned relatively. In this way, the user can take in-line skating sport.

If the user wants to take the wheels in the shoe sole 101, he/she also has to press the push bar 511 to make the guide bar 524 depart from the breach 442 of the fourth turning plate 44 such that the fourth turning plate 44 can be taken in the placing room 12 of the base 1. Other turning plates are also driven to move due to the linkage set 2 such that the wheels 20 combined among the wheel position mechanism 4 can be taken in the sole 101 of the body of the shoe. When the guide bar 524 returns to the original position due to the elastic force of the torsion spring 521, the guide bar 524 can clip with the breach 441 of the fourth turning plate 44 such that the wheels 20 are steadily taken in the placing room 12 of the base 1.

Otherwise, the protruding block 515 of the push bar 511 ordinarily holds to the wall surface of the rear of the base 1 such that the push bar 511 can't be pressed ordinarily to avoid the condition that the wheels 20 spring out the sole 101 due to contacting the push bar 511 carefullessly. When needing using the wheels 20, the user just turns the protruding block for a certain angle to aim at the guide hole 13 to make the push bar 511 be able to been pressed such that the purpose of usage safety is achieved.

With comparing with other commonly seen technologies, a combined structure of a sports shoe and an in-line skate provided from the present invention has following advantages:

1. The in-line wheel device in the present invention is buried in the sole of the body of the shoe, so the body of the shoe has the functions of walking, running and taking in-line skating sport for the user.
2. The control mechanism is combined to the rear of the in-line wheel device in the present invention to control the wheels to been unfolded or taken in, so the in-line skate has the automatic unfolding and taking in function and the attached value can be increased.
3. Every turning plate is joined with each other in the linkage set in the present invention, so as long as a turning plate act, then other turning plates are driven synchronically such that the purpose of easy control is achieved Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A combined structure of a sports shoe and an in-line skate, comprising:

a base having a wheel placing space set at a bottom surface thereof and having a placing room disposed adjacent a rear end of said base, said placing room having a top surface with a transverse channel and a lengthwise slot being formed therein, said rear end of said base having a guide opening formed therein, said base having a trench formed in a rear lateral side thereof, said trench passing through said placing room, said base having two pair of position columns respectively formed at both front and rear portions of opposing lateral sides thereof;

a control mechanism composed of a control part and a guide part, said control part including a push bar, a compression spring and a hollow washer slipped on said push bar, said control part being placed in said guide opening on said rear end of said base, said guide part including a guide arm clipping with a guide bar at a front end and having a trough at a rear end, a first torsion spring setting in said trough, a position bar passing through said trough and said first torsion spring and being placed into said transverse channel of said placing room of said base, said guide bar jutting out from said trench at both rear lateral sides of said base, a first end of said first torsion spring holding to said trough of said guide bar while a second end of said torsion spring holding to said lengthwise slot, a upper cover being covered above said placing room and said trench such that said control mechanism can be combined at the rear of said base;

a linkage set including a first, a second, and a third link, a pair of ends of both said first and third link being bent to a predetermined angle and each respectively having a pair of joining holes formed at opposing ends thereof, said second link being in a step shape and having a pair of joining holes formed at opposing ends thereof for respectively joining said second link with said first link and third link to have a driving motion;

a position plate having a pair of position holes formed at opposing ends thereof, said position plate having at least one arc slot Conned therein, a plate-hole being formed above a concave side of each said at least one arc slot, and a guide slot extending from an end of one of said at least one arc slot;

a wheel position mechanism including at least one turning plate, said at least on turning plate having a pair of first holes formed at a top end thereof and a second hole formed at a bottom end for joining with a wheel, one of said at least one turning plate having first breach and a second breach respectively formed at first and second predetermined positions on an upper and lower end thereof for clipping;

wherein said linkage set, said positioning plate and said wheel position mechanism are combined in order at said front and rear portions of said lateral sides of said base, at least one position pin and a shaft bar respectively passing through said pair of first holes at said top end of said at least one turning plate, said at least one arc slot and said plate-hole, and said joining holes of corresponding links of said linkage set such that said linkage set, said positioning plate and said wheel position mechanism are combined at both ends of said base, said pair of position holes of said position plate being joined to said pair of position columns at each end of said base such that said position plate is secured to both ends of said base, a second torsion spring being slipped on one said at least one position pin, a first end of said second torsion spring holding to said shaft bar corresponding to said position pin and a second end of said second torsion spring holding to said placing room of said base, said guide bar passing through said guide slot of said arc slot of said position plate and clipping with said first or second breach, each wheel being joined between a corresponding turning plate of said in-line wheel device and arranged in an in-line state.

2. The combined structure of a sports shoe and an in-line skate as recited in claim 1, wherein said position plate has a first, a second, a third and a fourth arc slot, said guide slot extending from said fourth arc slot.

3. The combined structure of a sports shoe and an in-line skate as recited in claim 1, wherein said wheel position mechanism has a first, a second, a third and a fourth turning plates, said first and second breach respectively being respectively formed in said upper and lower ends of said fourth turning plate.

* * * * *